US006176289B1

(12) United States Patent
McReynolds

(10) Patent No.: US 6,176,289 B1
(45) Date of Patent: Jan. 23, 2001

(54) BLIND SYSTEM FOR WINDOWS

(76) Inventor: David McReynolds, 4517 W. Ely Rd., Hannibal, MO (US) 63401

( * ) Notice: Under 35 U.S.C. 154(b), the term of this patent shall be extended for 0 days.

(21) Appl. No.: 09/375,190

(22) Filed: Aug. 16, 1999

(51) Int. Cl.[7] ..... E06B 9/30
(52) U.S. Cl. ..... 160/168.1 R; 160/236
(58) Field of Search ..... 160/236, 176.1 R, 160/178.1 R, 168.1 R, 900

(56) References Cited

U.S. PATENT DOCUMENTS

| | | | |
|---|---|---|---|
| 2,505,155 | 4/1950 | Smith . | |
| 3,645,317 | 2/1972 | Malone . | |
| 4,316,493 | 2/1982 | Arena . | |
| 4,336,834 | 6/1982 | Schaller . | |
| 4,487,243 | 12/1984 | Debs . | |
| 4,628,980 | 12/1986 | Le Houillier . | |
| 4,799,526 | 1/1989 | Reeves . | |
| 4,842,036 | 6/1989 | Goodman . | |
| 4,884,615 | 12/1989 | Hsu . | |
| 5,029,413 | 7/1991 | Jovanovic . | |
| 5,094,286 | 3/1992 | Hansen . | |
| 5,119,871 | 6/1992 | Schwaegerle . | |
| 5,165,459 * | 11/1992 | Gaber et al. | 160/176.1 R |
| 5,203,394 | 4/1993 | Hailey . | |
| 5,209,282 | 5/1993 | Franco et al. . | |

FOREIGN PATENT DOCUMENTS

| | | | |
|---|---|---|---|
| 2044328 * | 10/1980 | (GB) | 160/236 |
| 2170256 * | 7/1986 | (GB) | 160/236 |

* cited by examiner

*Primary Examiner*—Blair M. Johnson
(74) *Attorney, Agent, or Firm*—Michael I. Kroll

(57) ABSTRACT

A blind system for regulating light entering a window frame of a window. The blind system includes a support bar affixed to an interior top portion of the window frame, a plurality of prism shaped slat members connected to and extending from the support bar and a device for selectively pivoting the slat members to both change an angle at which the light passes through the slat members and change an amount of light permitted to enter the room through the slat members. The slat members are able to refract light passing through the window and thereby redirect light passing therethrough. The slat members are connected to extend either vertically or horizontally from the support bar. A device for adjusting a height of the slat members above a bottom side of the window frame is provided when the slat members extend horizontally. The slat members are also able to pivot within a 180° range of rotation. A device is also provided for regulating the height of the horizontal slat members or regulating the extension of the vertical slat members across the width of the window frame.

7 Claims, 7 Drawing Sheets

BLIND SYSTEM FOR WINDOWS

U.S. Pat. No. 2,505,155

Inventor: Gordon K. Smith

Issued: Apr. 25, 1950

A transparent closure device embodying a frame. A plurality of closure louvers are mounted in the frame to swing in a horizontal plane. End channels are for supporting the opposite ends of each louver. The louvers are formed concave-convex throughout the major portion of their length transversely. The terminal ends of each louver is formed flat transversely for engagement in the channels. The opposite longitudinal edges of the louvers are beveled at an identical angle throughout their length. The ends of the channels are closed and beveled at an angle identical to the angle of the edges of the louvers. The bevel of the channels engaging the bevel of the louvers form a continuous beveled edge throughout the louver and the channels. The louvers and the channels are adapted to overlie each other in beveled engagement when in the closed position, to provide an uninterrupted continuous surface to the closure device.

U.S. Pat. No. 4,628,980

Inventor: James G. LeHouillier

Issued: Dec. 16, 1986

A louver having clear transparent C-shaped holding flanges for holding decorative panels. The transparent holding flange on each longitudinal edge of each louver in a vertical louver system is held vertical by a louver track system. The louvers are moveable from an overlapped closed position to an open position. Each louver has a main body portion of opaque material. The C-shaped holding flanges or edge portions include two transparent longitudinal edge portions, one on each longitudinal edge of the long louver. The transparent edge portion is equal in width to a transparent inwardly facing flange portion positioned over each longitudinal edge portion. The transparent edge portion and transparent inwardly facing portion are connected together and separated by a transparent mid portion of a width generally equal to the thickness of a decorative member. The transparent material allows the edges of an inserted piece of decorative material to be viewed through the transparent, inwardly facing portions.

U.S. Pat. No. 4,842,036

Inventor: Barry I. Goodman

Issued: Jun. 27, 1989

Laminates particularly useful in vertical blind slat assemblies, and vertical blind slat assemblies utilizing the laminates are disclosed. The laminates comprise strand material which is not free hanging and in which there are substantial spaces between the strands to allow light to pass through the material, and a sheet-like layer to which the strand material is secured so that the strands of the laminate are fixed. The laminates allow the color or other characteristics of a slat member or insert to be seen. The laminates can have differing surface characteristics, (e.g. texture) and strand colors, sizes and patterns. The sheet-like layer can be transparent or translucent. A laminate can be secured directly, for example by adhesive, to a slat member having light-transmitting properties (e.g. opaque or translucent), surface characteristics (e.g. texture) and/or color which affect the overall appearance of the slat. A laminate can be removably secured to a groover slat member which can have light transmitting properties, surface characteristics and/or color which affect the overall appearance of the slat. An insert can be disposed between the laminate and the groover slat which itself has light-transmitting properties (e.g. opaque, translucent), surface characteristics and/or color or print which affect the overall appearance of the slat. The laminate allows the insert and/or slat member to be seen, to provide color, etc. to the slat assembly. The laminates allow a vertical blind slat to be assembled easily from a particular laminate and slat member, and insert if used. By stocking a limited number of laminates, slat members and inserts, a wide variety of slat assemblies can be provided. The laminates can have a plastic or fabric second layer to which the strand material is secured.

U.S. Pat. No. 5,203,394

Inventor: Anderson Hailey

Issued: Apr. 20, 1993

The triangular shape of the louvers allow light to pass through the first and second color-tinted adjacent sides to add a soft color hue to a room. The third side of the triangular louver is opaque and acts much the same as does a common blind when used to block the light from entering a room. The third side may, however, have a decorative scent or pattern on it to present a pleasant scene to the onlooker. The third side has a rotation restriction and alignment tab on it to align the third sides of the louvers, so that the decorative pattern or scene is clearly illustrated and that the louver is positioned to properly block the light. Each louver is removably attached to a support system in such a manner that the louvers may be rotated, to allow light to pass through two of the adjacent sides and then be rotated so that the opaque third side is parallel to the window or door and restricts the passage of the light.

SUMMARY OF THE PRESENT INVENTION

The instant invention relates generally to shade devices for windows and, more specifically, to a system for refracting light passing through a window while also dimming the light and allowing only opaque silhouettes to be seen therethrough on an outside of the window.

A primary object of the present invention is to provide a blind system that will overcome the shortcomings of the prior art devices.

Another object of the present invention is to provide a blind system including slat members which are at least partially light transmissive, similar to the optical effect produced by passing light through glass blocks.

A further object of the present invention is to provide a blind system which is easily and conveniently installed within an existing window frame.

A yet further object of the present invention is to provide a blind system having tinted slats for restricting the amount of light allowed to pass therethrough and refracting any light allowed to pass therethrough.

A still further object of the present invention is to provide a blind system wherein the slats refract light passing therethrough and allow only opaque silhouettes to be viewed therethrough.

An additional object is to provide a blind system wherein its slat members are positioned to extend either vertically or horizontally within the window frame.

An even further object of the present invention is to provide a blind system wherein the slats are color tinted to give a stained glass appearance.

A still further object of the present invention is to provide a blind system that is simple and easy to use.

A yet further object of the present invention is to provide a blind system that is economical in cost to manufacture.

Further objects of the invention will appear as the description proceeds.

A blind system for regulating light entering a window frame of a window is disclosed by the present invention. The blind system includes a support bar affixed to an interior top portion of the window frame, a plurality of prism shaped slat members connected to and extending from the support bar and a device for selectively pivoting the slat members to both change an angle at which the light passes through the slat members and change an amount of light permitted to enter the room through the slat members. The slat members are able to refract light passing through the window and thereby redirect light passing therethrough. The slat members are connected to extend either vertically or horizontally from the support bar. A device for adjusting a height of the slat members above a bottom side of the window frame is provided when the slat members extend horizontally. The slat members are also able to pivot within a 180° range of rotation. A device is also provided for regulating the height of the horizontal slat members or regulating the extension of the vertical slat members across the width of the window frame.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

DESCRIPTION OF THE REFERENCED NUMERALS

Figure 1:
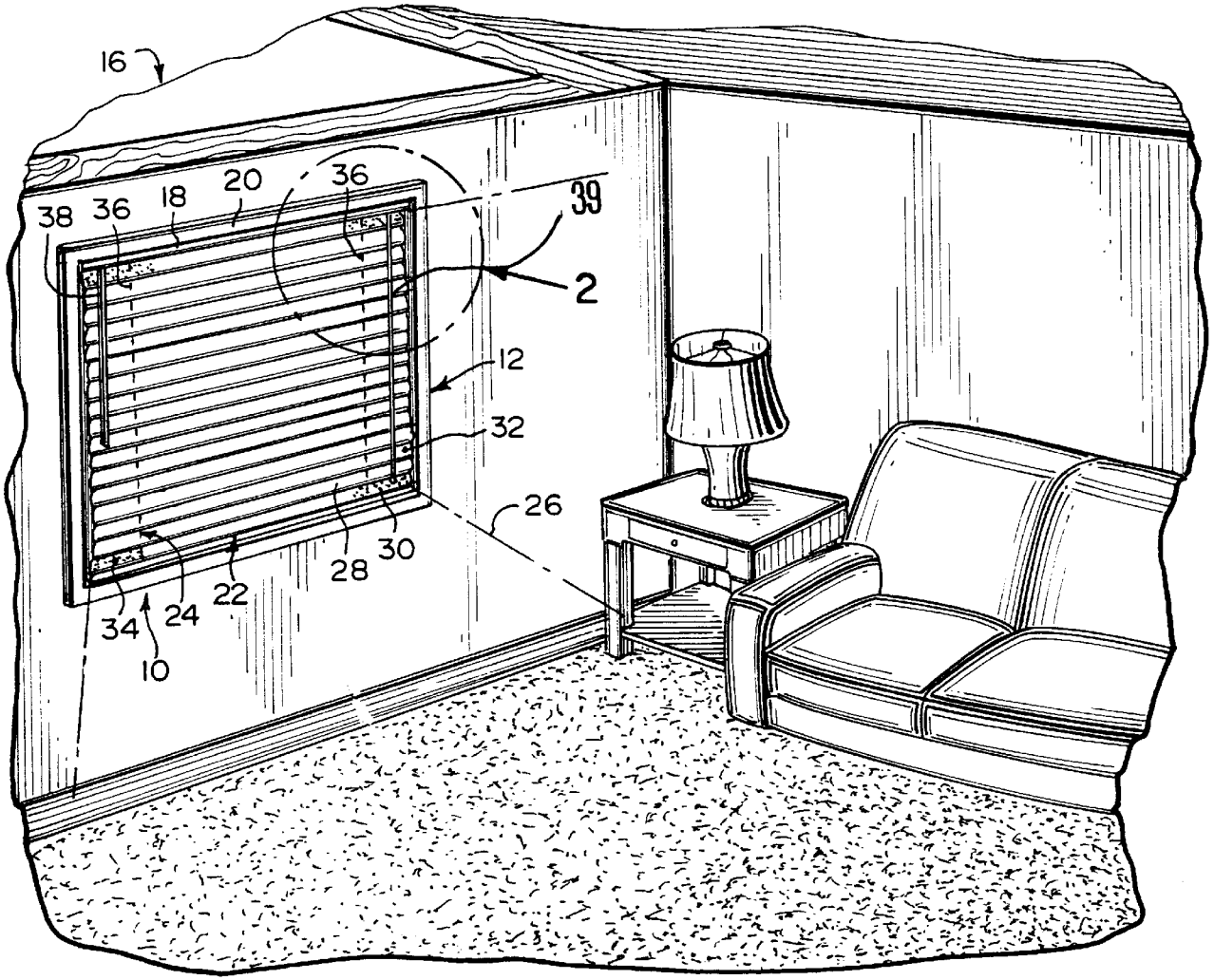
FIG. 1 is a perspective view of the blind system of the present invention wherein the slat members extend horizontally within a window frame of a building.

Turning now descriptively to the drawings, in which similar reference characters denote similar elements throughout the several views, the Figures illustrate the blind system of the present invention. With regard to the reference numerals used, the following numbering is used throughout the various drawing figures.

10 horizontally hanging blind system of the present invention
12 window frame
14 window
16 room
18 support bar of horizontally hanging blind system
20 interior top portion
22 slat member of horizontally hanging blind system
24 pivot suspending structure of horizontally hanging blind system
26 sunlight
28 transparent thin narrow strip of slat member
30 coating on transparent thin strip
32 clear acrylic plastic material for transparent thin strip
34 plastic material for coating
36 braided ladder of pivot suspending structure
37 tilt rod
38 tubular wand of pivot suspending structure
39 string for raising and lowering slat members
40 vertically hanging blind system
42 support bar of vertically hanging blind system
44 slat member of vertically hanging blind system
46 pivot suspending structure of vertically hanging blind system
48 transparent thin narrow flat strip of slat member
50 coating on transparent strip
52 clear acrylic plastic material for transparent strip
54 plastic material for coating
56 track member of pivot suspending structure
58 tubular wand of pivot suspending structure
60 sun
62 rays of sunlight emanating from sun
64 ray of light impinging on slat member
66 angle of refraction of ray of light passing through first side of slat member
68 first side of slat member
70 second side of slat member
72 angle of refraction of ray of light passing through second side of slat member
74 angle of refraction of ray of light passing through first side of slat member
76 angle of refraction of ray of light passing through second side of slat member
78 silhouette

DETAILED DESCRIPTION OF THE PREFERRED EMBODIMENT

Turning now descriptively to the drawings, in which similar reference characters denote similar elements throughout the several views, FIGS. 1–7 illustrate the blind system of the present invention indicated generally by the numeral 10.

Figure 2:
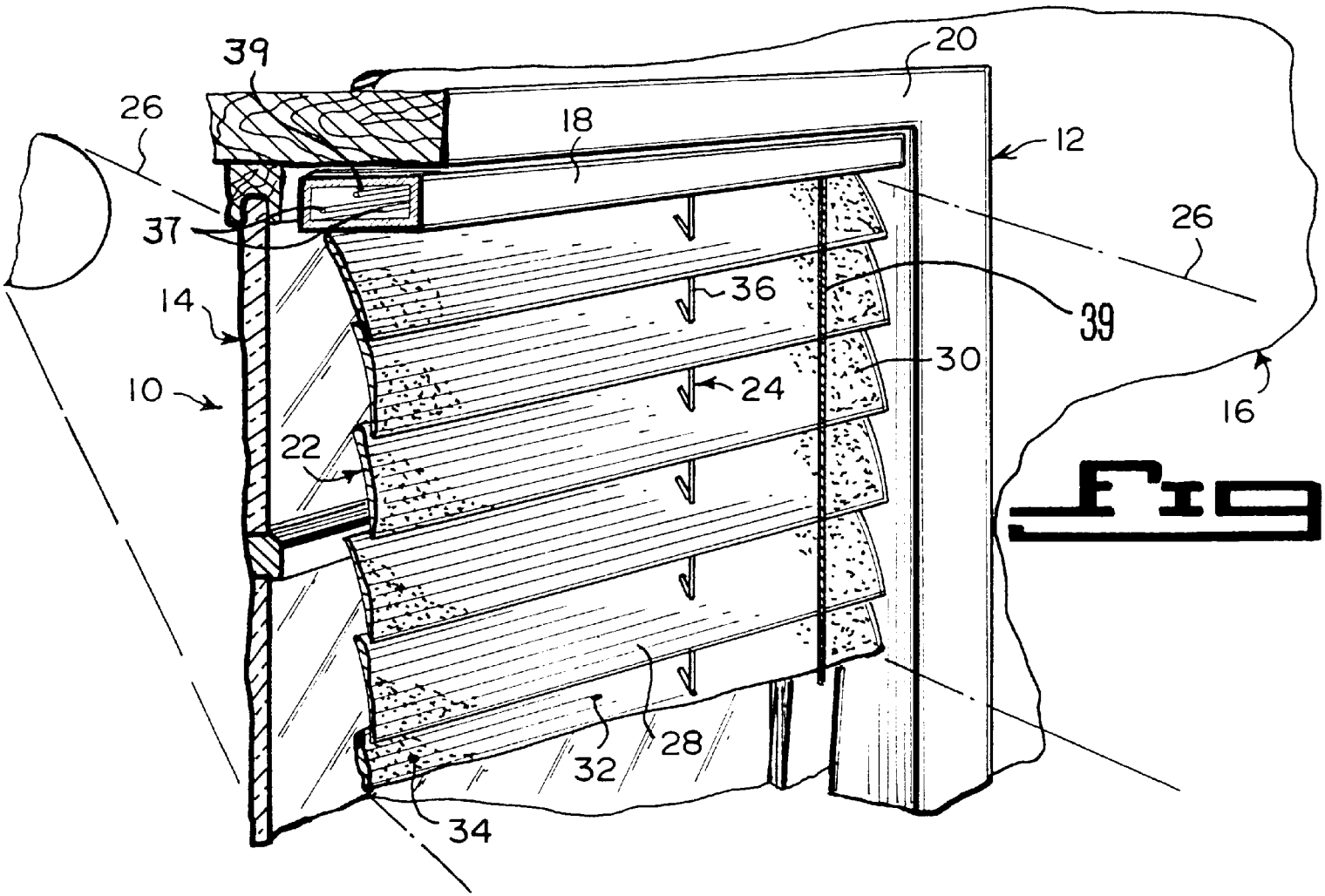
FIG. 2 is an enlarged perspective view of the blind system of the present invention in the window frame of the building as indicated by arrow 2 in FIG. 1.
Figure 5:
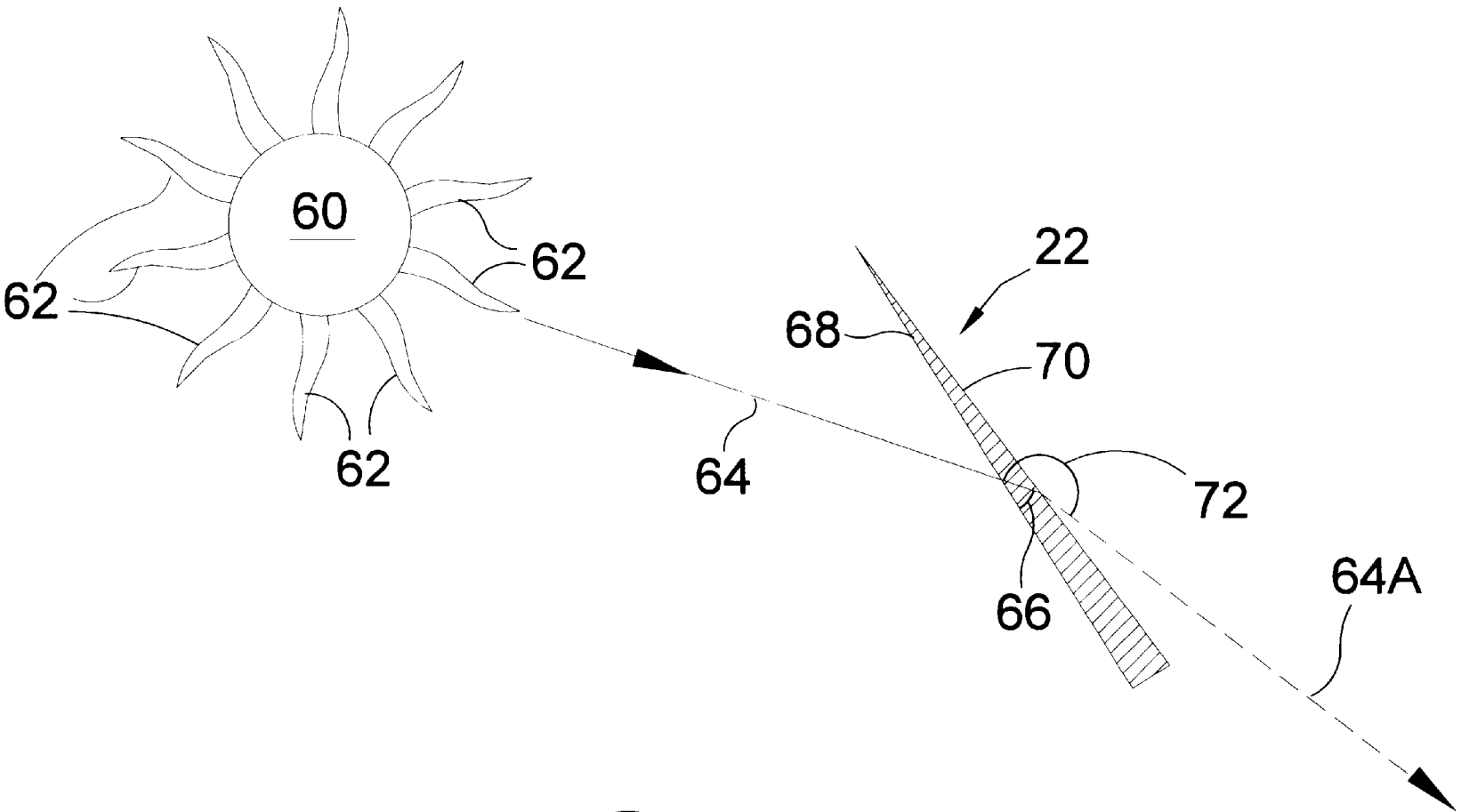
FIG. 5 is a side view of a single slat of the blind system of the present invention positioned at a first end of its range of pivotal movement, showing the refraction of light passing through the slat downward towards the ground.
Figure 6:
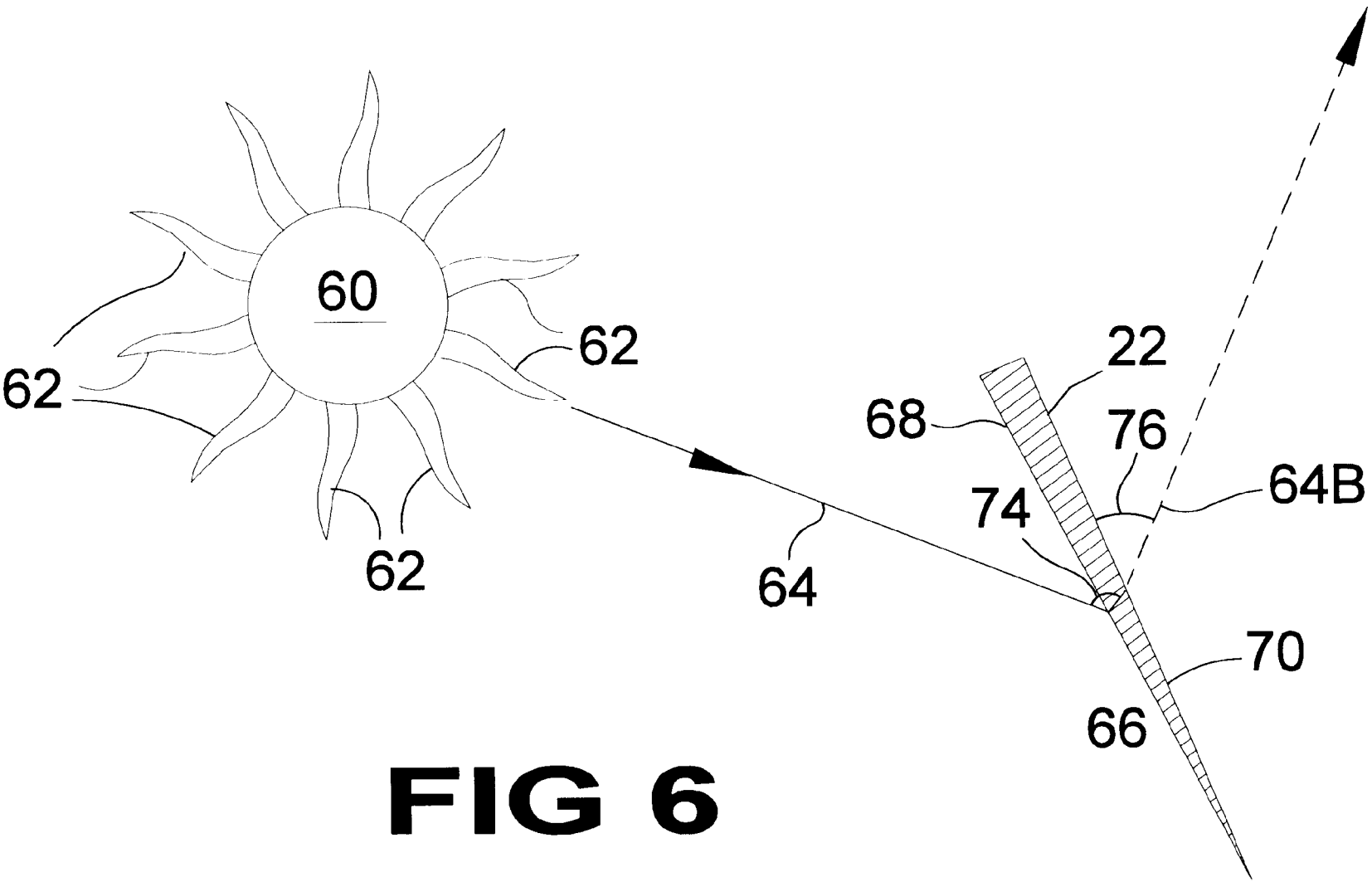
FIG. 6 is a side view of a single slat of the blind system of the present invention at a second end of its range of pivotal movement, showing refraction of light passing through the slat upward towards the ceiling.

FIGS. 1 and 2 illustrate the blind system 10 of the present invention hanging horizontally in a frame 12 of a window 14 located in a room 16 of a building. The blind system 10 includes a support bar 18 affixed to an interior top portion 20 of the window frame 12. A plurality of slat members 22 are provided hanging from the support bar 18. The slat members 22 have a prism-like structure as is shown in FIGS. 5 and 6 and are thus light transmissive. Any light passing therethrough is refracted downward towards the ground, see FIG. 5, upwards towards the ceiling, see FIG. 6, or at any angle therebetween into a room 16 in which the blind system 10 is situated. The direction at which the light is refracted is dependent upon the angle at which the slat members 22 extend. The optical effect produced by the slat members 22 is similar to light passing through glass blocks.

A structure 24 is provided for pivotally suspending the slat members 22 from the support bar 18 in horizontal parallel relationship with one another. The slat members 22 can be pivoted into an open position, to allow sunlight 26 to enter the building 16 through the window 14 and can be pivoted into a closed position for privacy. The slat members 22 are able to pivot throughout a 180° range of rotation to allow most or none of the light impinging on the window to pass therethrough unrefracted.

Each slat member 22 includes a transparent, thin, narrow, slightly strip 28. A coating 30 is applied completely to one surface of the strip 28. The strip 28 is fabricated out of a clear acrylic plastic material 22. The coating 30 is translucent. The coating 30 can be color tinted to produce a stained glass appearance and thus dim any light passing through the slat members 22. The coating 30 is also made out of a plastic material 34.

The pivot suspending structure 24 consists of a pair of spaced apart braided ladders 36 extending through and retaining the slat members 22 at a desired position. A tubular wand 38 is connected to the braided ladders 36 for pivoting the slat members 22 throughout its 180° range of rotation. A string 39 is also provided for raising and lowering the height of the slat members 22 to thereby further control the amount of light allowed to enter the room 16. As seen in FIG. 2, the conventional arrangement of lift cords 39 and tilt rod 37 provide the means of lifting and rotating slat members 22. This particular arrangement is not a novel part of this invention.

Figure 3:
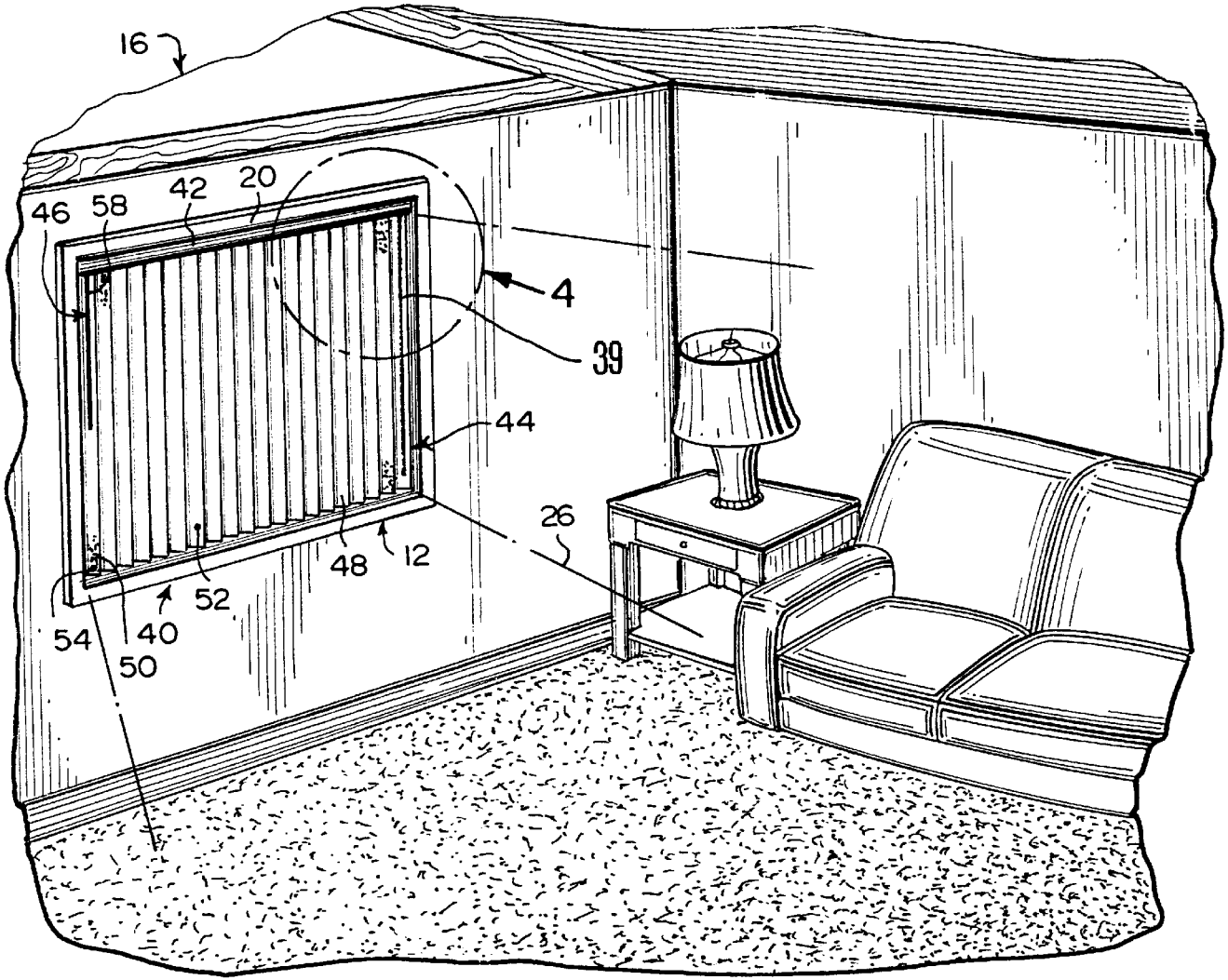
FIG. 3 is a perspective view of the blind system of the present invention wherein the slat members extend vertically within a window frame of a building.
Figure 4:
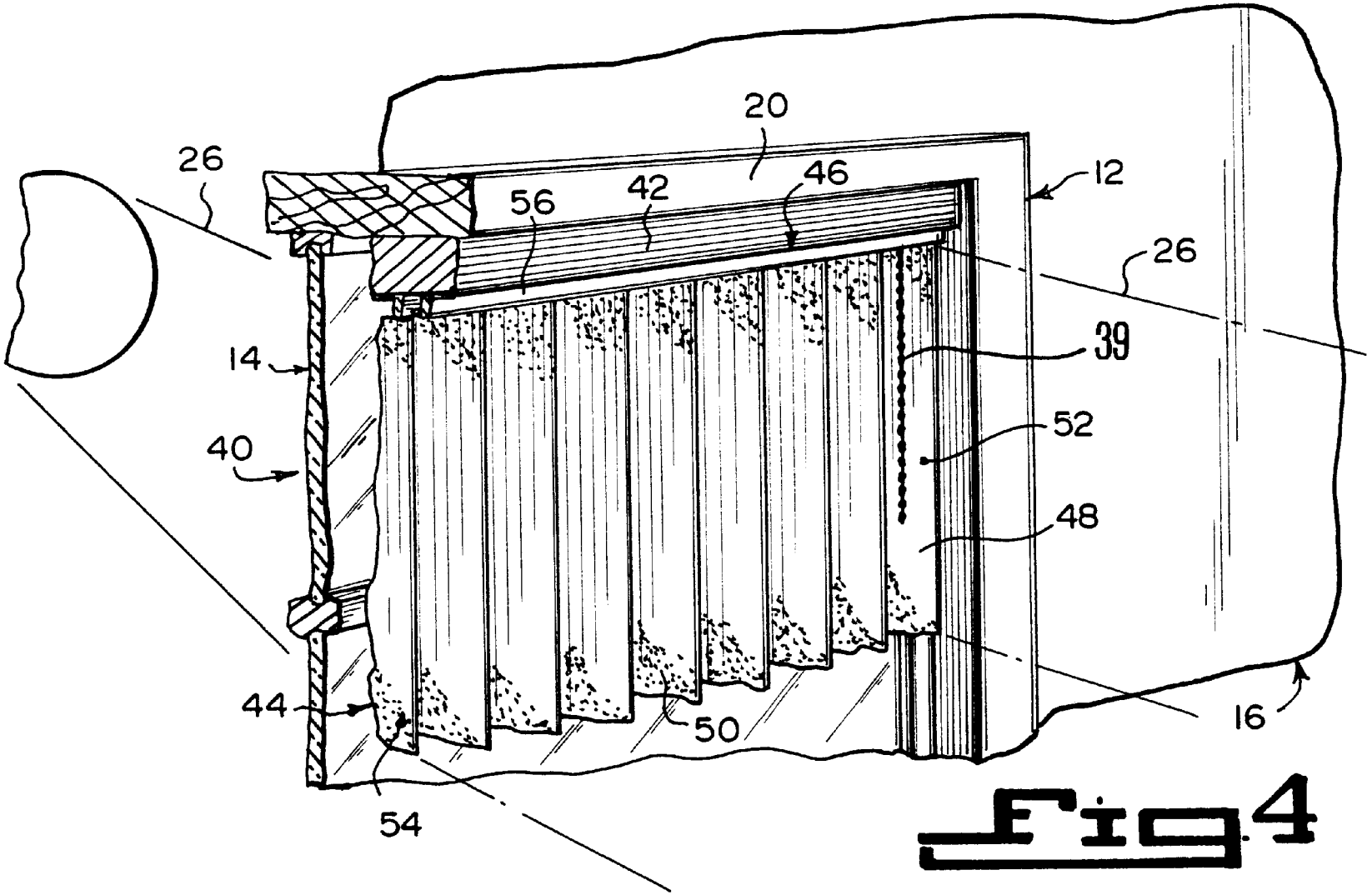
FIG. 4 is an enlarged perspective view of the blind system of the present invention in the window frame of the building as indicated by arrow 4 in FIG. 3.

FIGS. 3 and 4 illustrate the blind system 40 of the present invention extending vertically from a top of the window frame. The vertically extending blind system 40 is provided for regulating the amount of light passing through the window 14 in the room 16. Similarly to the horizontally extending blind system 10, the vertically extending blind system 40 includes a support bar 42 affixed to an interior top portion 20 of the window frame 12. A plurality of slat members 44 are provided hanging vertically from the support bar 42. The slat members 22 have a prism-like structure as is shown in FIGS. 5 and 6 and are thus light transmissive. Any light passing therethrough is refracted downward towards the ground, see FIG. 5, upwards towards the ceiling, see FIG. 6, or at any angle therebetween into the room 16 in which the blind system 40 is situated. The direction at which the light is refracted is dependent upon the angle at which the slat members 22 extend. The optical effect produced by the slat members 22 is similar to light passing through glass blocks.

A structure 46 is provided for pivotally suspending the slat members 44 from the support bar 42 in vertical parallel relationship with each other. The slat members 44 can be pivoted throughout a 180° range of rotation to allow most or none of the light impinging on the window 14 to pass therethrough unrefracted.

Each slat member 44 includes a transparent, thin, narrow, flat strip 48. A coating 50 is applied completely to one surface of the strip 48. The strip 48 is fabricated out of a clear acrylic plastic material 52. The coating 50 is translucent. The coating 50 can be color tinted to produce a stained glass appearance and act to tint or dim light being refracted by the slat members 44. The coating 50 is also made out of a plastic material 54.

The pivot suspending structure 46 consists of a track member 56 mounted to the underside of the support bar 42. The track member 56 will hold the slat members 44 in a vertically extending position therefrom. A tubular wand 58 is provided, to pivot the slat members 44 throughout their 180° range of rotation.

FIG. 5 illustrates a single slat member 22 of the blind system 10 positioned at an angle defining a first end position of the range of rotation thereof. As can be seen from this figure, the slat member 22 is tinted to thereby dim any light impinging thereon and passing through the slat member 22. The sun 60 is shown emanating rays of light 62, some of which are directed towards the slat member 22. One ray of light 64 is shown impinging on the slat member 22. The ray of light 64 is refracted upon passing through a first side 68 of the slat member 22 at an angle 66 to the first side 68 of the slat member 22. The ray of light 64 passes through the slat member 22 and upon contacting a second side 70 of the slat member 22 is again refracted at an angle 72 towards the ground of the room 16 in which the blind system 10 is positioned. The light that passes through the slat member 22 is decreased in its intensity as the tinting of the slat member dims the light. Furthermore, light passing through the slat members 22 is directed away from the eyes of persons in the room as it is refracted to pass through the slat members and be directed towards the ground. Sunlight which is impinging on the slat members 22 is at least partially able to shine through into the room 16 between the slat members 22 and thus provide additional light to the room 16 while maintaining a level of privacy within the room 16.

FIG. 6 illustrates a slat member 22 pivoted to a second end of their 180° range of rotation from the position of the slat member 22 shown in FIG. 5. As can be seen from this figure, the slat member 22 is tinted to dim any light impinging thereon and passing through the slat member 22. The sun 60 is shown emanating rays of light 62, some of which are directed towards the slat member 22. One ray of light 64 is shown impinging on the slat member 22. The ray of light 64 is refracted upon passing through the first side 68 of the slat member 22 at an angle 74 to the first side 68 of the slat member 22. The ray of light 64 passes through the slat member 22 and upon contacting a second side 70 of the slat member 22 is again refracted at an angle 76 towards the ceiling of the room 16 in which the blind system 10 is positioned. The light that passes through the slat member 22 is decreased in its intensity as the tinting of the slat member 22 dims the light. Furthermore, light passing through the slat members 22 is directed away from the eyes of persons in the room as it is refracted to pass through the slat members and be directed towards the ceiling of the room 16. Sunlight which is impinging on the slat members 22 is prevented from shining through the room 16 between the slat members 22. The angle at which the light passing through the slat members 22 is adjusted by rotation of the slat members 22 and can be directed at any angle between the extreme angles illustrated in FIGS. 5 and 6.

Figure 7:
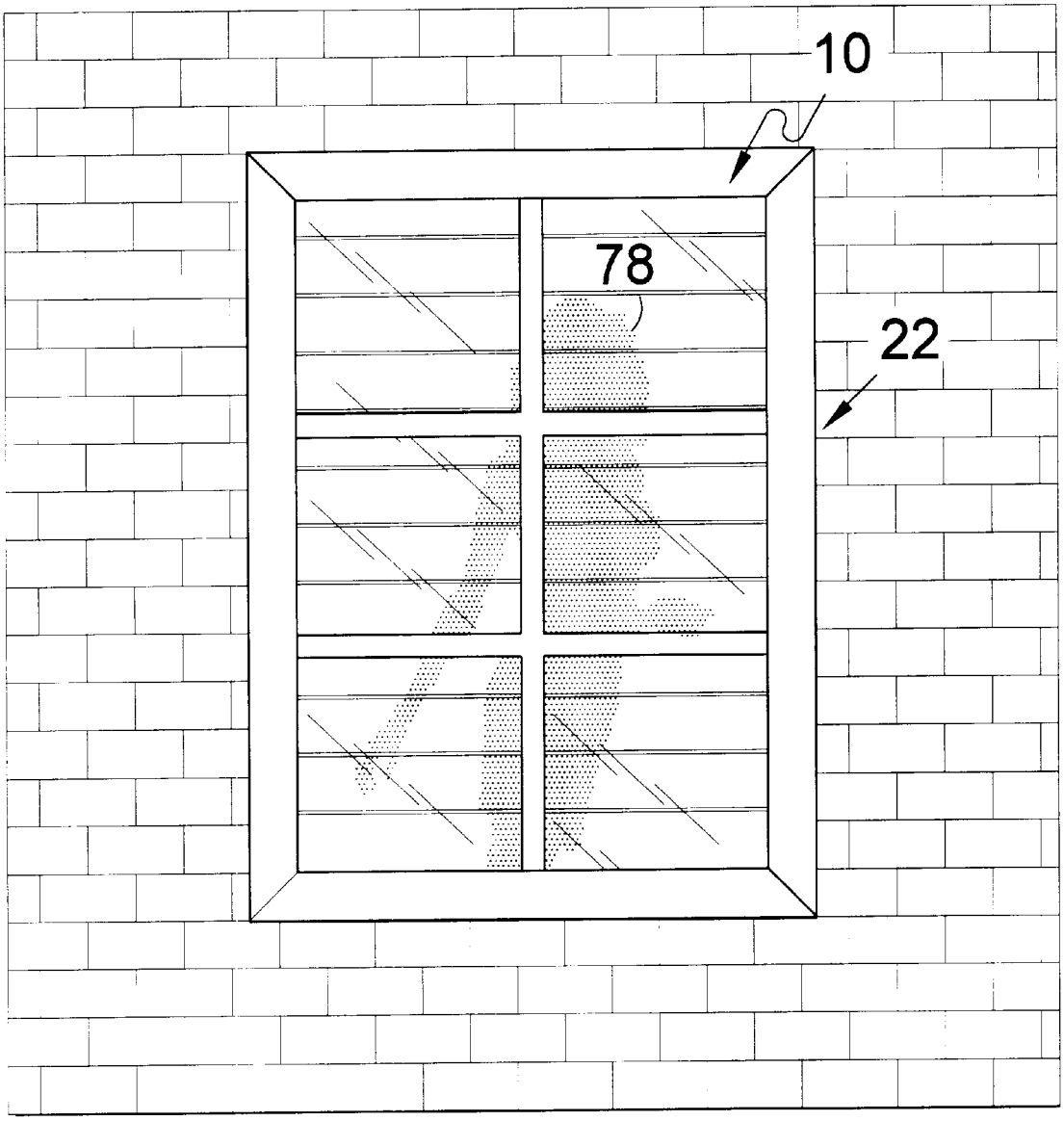
FIG. 7 is a front view of the blind system of the present invention showing an opaque silhouette passing therethrough for viewing on an outside of the window.

FIG. 7 provides a view of the blind system of the present invention from outside a room in which it is positioned. As can be seen from this figure, the slat members are rotated to a position refracting all light passing through the window 14. Due to the tinting of the slat members 22 and the opaque nature of the prism structure forming the slat members 22, only silhouettes 78 may be seen through the slat members 22 from outside the room. As only silhouettes 78 can be seen through the slat members 22, a level of privacy and anonymity is maintained for persons within the room. Furthermore, persons looking into the room through the slat members 22 are prevented from viewing or spying on the persons in the room 16 as only blurred silhouettes may be seen, similar to looking at an object through a prism.

The operation of the blind system 10 will now be described with reference to the figures. In operation, the blind system 10, 40 is positioned to cover a window 14 of a room 16. The height at which the slat members 22 cover the window 16 is adjustable using the string 39 to adjust the height of the slat members 22 to a desired level and the tubular wand 38 is turned to adjust the angle of the slat members 22. Adjustment of the slat members 22 using the tubular wand 38 controls the angle of refraction of the light passing through the slat members 22.

Once the height and angle of the slat members 22 is set, the blind system 10, 40 of the present invention will act to refract at least a portion of light entering through a window 16 in which it is positioned. If the slat members 22 are angled between a parallel relationship to the ground and as indicated in FIG. 5, the light will be refracted towards the ground of the room 16. If the slat members 22 are angled between a parallel relationship to the ground and as indicated in FIG. 6, the light will be refracted towards the ceiling of the room 16. The angle at which the light extends relative to the ground or ceiling is dependent upon the angle of the slat members relative to the parallel plane. The slat members 22 will thus direct the light away from persons in the room 16. The tinting of the slat members 22 also reduces the intensity of light passing therethrough. The angle and height of the slat members 22 may be adjusted using the tubular wand 38 and string 39 as the angle of the sun changes, to change the amount of light entering the room or to redirect the angle of the light entering the room 16 at any desired time.

From the above description it can be seen that the blind system of the present invention is able to overcome the shortcomings of prior art devices by providing a blind system which includes slat members which are at least partially light transmissive, similar to the optical effect produced by passing light through glass blocks, the slat members being tinted for restricting the amount of light allowed to pass therethrough and refracting any light allowed to pass therethrough. The blind system is easily and conveniently installed within an existing window frame and the slats refract light passing therethrough and allow only opaque silhouettes to be viewed therethrough. The slat members of the blind system are positioned to extend either vertically or horizontally within the window frame and are color tinted to give a stained glass appearance. Furthermore, the blind system of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A blind system for regulating light passing through a window frame of a window, said blind system comprising:

a) a support bar affixed to an interior top portion of the window frame;

b) a plurality of prism shaped slat members triangular in cross section having a pair of flat surfaces coming together to form an extended Pointed edge connected to and extending from said support bar, said slat members being able to refract light passing through the window and thereby redirect light passing therethrough;

c) means for selectively pivoting said slat members to thereby both change an angle at which the light is redirected by said slat members and change an amount of light permitted to enter the room through said slat members; and d) each slat member being made of transparent material and one flat surface thereof having a translucent coating.

2. The blind system as recited in claim 1, wherein said slat members are horizontally aligned with each other, a first one of said plurality of slat members being connected to said support bar.

3. The blind system of claim 1, wherein said pivoting means pivots said slat members within a 180° range of rotation.

4. The blind system as recited in claim 1, wherein said coating is color tinted to produce a stained glass appearance.

5. The blind system as recited in claim 1, wherein said coating is a plastic material.

6. The blind system as recited in claim 2, wherein each of said plurality of slat members includes first and second recesses extending therethrough on opposing ends thereof and said pivoting means includes:

a) first and second spaced apart braided ladders extending through said first and second recesses, respectively of each of said plurality of slat members; and b) a tubular wand for pivoting said slat members within a range of rotation of 180°.

7. The blind system as claimed in claim 6, further comprising a string connected to said plurality of slat members for adjusting a height of said plurality of slat members and thereby regulating an amount of light allowed to pass through the window unimpeded.

* * * * *